US009964380B1

(12) United States Patent
Oglesby

(10) Patent No.: US 9,964,380 B1
(45) Date of Patent: May 8, 2018

(54) RAIL ACCESSORY KEY ATTACHMENT SYSTEM

(71) Applicant: Paul Oglesby, Darley (GB)

(72) Inventor: Paul Oglesby, Darley (GB)

( * ) Notice: Subject to any disclaimer, the term of this patent is extended or adjusted under 35 U.S.C. 154(b) by 72 days.

(21) Appl. No.: 14/998,000

(22) Filed: Jan. 18, 2016

Related U.S. Application Data

(60) Provisional application No. 62/104,201, filed on Jan. 16, 2015.

(51) Int. Cl.
*F41C 27/00* (2006.01)

(52) U.S. Cl.
CPC ..... *F41C 27/00* (2013.01)

(58) Field of Classification Search
CPC ..... F41C 23/00; F41C 23/16; F41C 27/00
See application file for complete search history.

(56) References Cited

U.S. PATENT DOCUMENTS 8,925,236 B1 * 1/2015 Mayberry ..... F41G 11/005 42/124
9,222,756 B1 * 12/2015 Battaglia ..... F41C 27/00
9,696,112 B2 * 7/2017 Gottzmann ..... F41C 23/16
2014/0325889 A1 * 11/2014 Michal ..... F41G 11/003 42/75.01
2015/0219422 A1 * 8/2015 Kincel ..... F41C 23/16 29/525.11
2015/0285585 A1 * 10/2015 Hewes ..... F41C 23/16 42/71.01
2016/0223286 A1 * 8/2016 Storch ..... F41C 23/16

* cited by examiner

*Primary Examiner* — Gabriel Klein
(74) *Attorney, Agent, or Firm* — Shaddock Law Group, PC

(57) ABSTRACT

A rail accessory attachment system having one or more winged attachment nuts, wherein each winged attachment nut comprises two wing portions extending from a central portion of the winged attachment nut and a nut aperture formed through the winged attachment nut, wherein each winged attachment nut comprises a nut stop; an accessory portion having one or more accessory apertures, wherein each accessory aperture comprises at least one associated accessory stop; and wherein the nut aperture is aligned with the accessory aperture, such that a threaded portion of an attachment bolt interacts with a threaded portion of the nut aperture to rotatably attach or couple the winged attachment nut to the accessory portion, such that the nut stop is aligned relative to the accessory stop so that the winged attachment nut is rotatable relative to the accessory portion between a locked position and an unlocked position.

10 Claims, 18 Drawing Sheets

RAIL ACCESSORY KEY ATTACHMENT SYSTEM

ACROSS-REFERENCE TO RELATED APPLICATIONS

This patent application claims the benefit of U.S. Patent Application Ser. No. 62/104,201, filed Jan. 16, 2015, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearm handguards. More specifically, the present disclosure relates to a rail attachment system for a firearm handguard.

2. Description of Related Art

It has become commonplace to attach a free floating or other tube or rail system to the upper receiver of a rifle or other firearm, to be used as a handguard. In most applications, the handguard is attached to the firearm so that it extends from an upper receiver of the firearm and surrounds at least a portion of the firearm barrel.

Typically, such handguard are formed from aluminum or other alloys because of the ease with which the material can be extruded, cut to length, and machined. Furthermore, aluminum offers great strength to weight properties and is robust enough for the most demanding of requirements.

Ofttimes, handguards include one or more substantially dovetail shaped rail attachment features, such as, for example, a Picatinny or MIL-STD-1913 rail, a STANAG 2324 rail, or a tactical rail, that provide a mounting platform for various attachments and/or accessories. These rail attachment portions typically either run the entire length of the handguard or comprise rail attachment sections that are individually attached or secured to the handguard.

Several methods of attaching rail attachment portions or accessories to a handguard are simple bolt and methods, the KeyMod interface system, and the M-LOK system.

The KeyMod interface system is an open-source design released in an effort to standardize universal attachment systems in the firearm accessories market. The KeyMod system comprises the KeyMod slot and the KeyMod nut. The slot includes a larger diameter through-hole combined with a narrow slot that extends from one side of the through-hole. The slot is chamfered on the backside while the through hole is sized for clearance of a quick-detach sling swivel (approximately ⅜" diameter).

The KeyMod nut is stepped and the larger diameter end is chamfered around 270 degrees of its diameter. The angled face created is meant to interface with the chamfer on the backside of the KeyMod slot. The full diameter is left intact to create two flats on the nut, which align the nut to the slot, and allow it to be indexed to the accessory as well as to the KeyMod slot.

The M-LOK, or Modular Lock system also provides a direct attachment method for hard mounting accessories to an elongated slot or negative space mounting point. The M-LOK system comprises a series of comparatively long, rectangular slots, each having squared sides and cammed T-nuts/bolts. During use, the T-nuts are aligned with and inserted into the slot. An initial turn of the T-nuts bolt rotates the T-nut into an engagement position, which then allows the T-nut to be further tightened, via the bolt.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, known bolt in systems do not offer sufficient positional flexibility and do not provide a sufficient clamping surface area and attachments have to slide into position, making it difficult to mount items close together. The KeyMod can also slip backwards and come away from the handguard.

The rail accessory key attachment system of the present disclosure (or "RAK System") overcomes these and other issues present in the current rail accessory interface systems and methods by providing a new, robust, and precise attachment system for firearms handguards accessories, attachments, Picatinny rails, and the like.

In various exemplary, nonlimiting embodiments, the RAK System comprises one or more double-keyhole mounting apertures, at least one corresponding, winged attachment nut, a corresponding bolt, and an accessory portion. Each double-keyhole mounting aperture includes a larger diameter through-hole combined with two, comparatively more narrow keyhole slots that extend from opposing sides of the through-hole.

Each winged attachment nut includes a central portion having a substantially circular and at least partially cylindrical shape. Two wing portions extend from opposing sides of the central portion. The wing portions are comparatively more narrow than the central portion and an outer diameter of the central portion of each winged attachment nut is sized and shaped so as to be urged through a corresponding through-hole of the double-keyhole mounting aperture, while the wing portions of each winged attachment nut are sized and shaped so as to be urged through the keyhole slots.

Thus, the exterior shape of the winged attachment nut substantially corresponds to the shape of the double-keyhole mounting aperture.

An at least partially threaded aperture is formed through the winged attachment nut, along its longitudinal axis.

The accessory portion includes one or more apertures formed therethrough. Each aperture is spaced so as to be aligned with the through-hole of the double-keyhole mounting apertures. An accessory stop extends from a mating side of the accessory portion and is formed so as to interact with a nut stop that extends from a mating side of the winged attachment nut.

In various exemplary, nonlimiting embodiments, the RAK System comprises one or more winged attachment nuts, wherein each winged attachment nut comprises two wing portions extending from a central portion of the winged attachment nut and a nut aperture formed through the winged attachment nut, wherein each winged attachment nut comprises a nut stop; an accessory portion having one or more accessory apertures, wherein each accessory aperture comprises at least one associated accessory stop; and wherein the nut aperture is aligned with the accessory aperture, such that a threaded portion of an attachment bolt interacts with a threaded portion of the nut aperture to rotatably attach or couple the winged attachment nut to the accessory portion, such that the nut stop is aligned relative to the accessory stop so that the winged attachment nut is rotatable relative to the accessory portion between a locked position and an unlocked position.

In various exemplary, nonlimiting embodiments, the RAK System comprises one or more substantially rectangular mounting apertures, at least one corresponding, winged attachment nut, a corresponding bolt, and an accessory portion.

Each winged attachment nut includes a central portion having a substantially circular and at least partially cylindrical shape. Two, substantially "S" or "Z" shaped wing portions extend, substantially radially, from opposing sides of the central portion. Each of the substantially "S" or "Z" shaped wing portions is comparatively more narrow than the central portion and an outer diameter of the central portion of each winged attachment nut is sized and shaped so as to be urged through a corresponding through-hole of the substantially rectangular mounting aperture, while the substantially "S" or "Z" shaped wing portions of each winged attachment nut are sized and shaped so as to be urged through the substantially rectangular mounting apertures when in an unlocked position and the substantially "S" or "Z" shaped wing portions of each winged attachment nut are sized and shaped so as to be kept from being urged through the substantially rectangular mounting apertures when in a locked position.

Accordingly, the presently disclosed system separately provides a rail accessory attachment system for a handguard.

The presently disclosed system separately provides a rail accessory attachment system that can be tightened down with sufficient force to provide a strong fixing position.

The presently disclosed system separately provides a rail accessory attachment system that has a design that is easy to manufacture and reduces cost.

The presently disclosed system separately provides a rail accessory attachment system that includes mounting apertures that support an attachment area and reduce slip in any direction.

The presently disclosed system separately provides a rail accessory attachment system wherein the locking section is machined into the rail section.

The presently disclosed system separately provides a rail accessory attachment system wherein the locking section will not damage polymer handguards.

The presently disclosed system separately provides a rail accessory attachment system that provides flexible positioning using a repeated mounting hole pattern.

The presently disclosed system separately provides a rail accessory attachment system that does not require lateral movement to be engaged in a locking position.

The presently disclosed system separately provides a rail accessory attachment system wherein less handguard space is required to mount accessories.

The presently disclosed system separately provides a rail accessory attachment system, wherein all that is required on the handguard side is at least one mounting aperture that can be milled through the handguard, with standard tooling.

These and other aspects, features, and advantages of the present disclosure are described in or are apparent from the following portion detailed description of the exemplary, non-limiting embodiments of the present disclosure and the accompanying figures. Other aspects and features of embodiments of the present disclosure will become apparent to those of ordinary skill in the art upon reviewing portion the following portion description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present systems are disclosed herein; however, it is to be understood that the disclosed embodiments are merely exemplary of the disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of this disclosure will be described in detail, with reference to the following portion figures, wherein like reference numerals refer to like parts throughout the several views, and wherein.

DETAILED DESCRIPTION OF THE INVENTION

Figure 1:
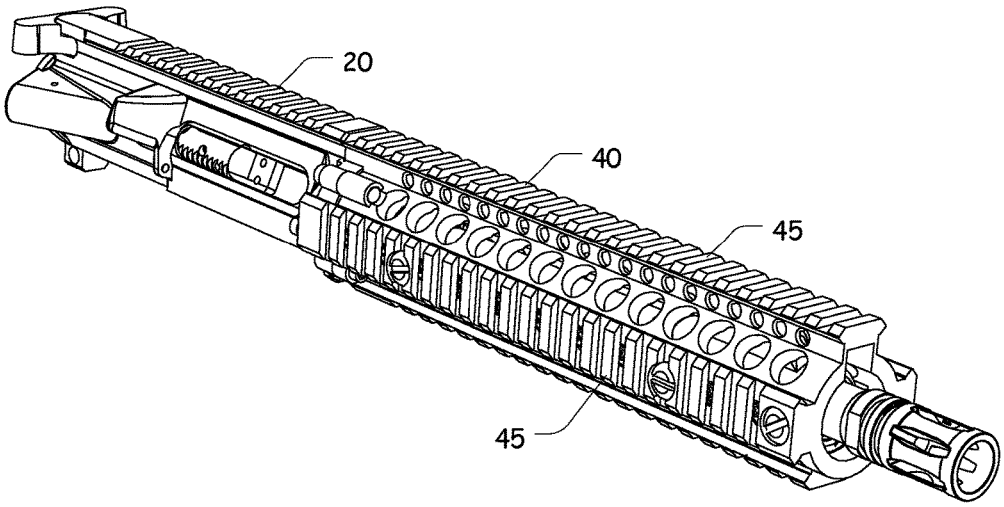
FIG. 1 PRIOR ART
FIG. 1 illustrates a perspective view of certain components of an AR-15 style upper receiver, having an attached, free float handguard.
Figure 2:
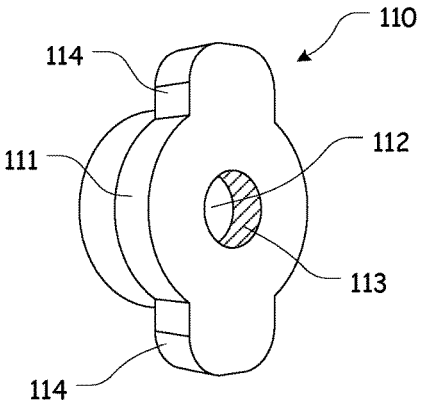
FIG. 2 illustrates a first, front perspective view of an exemplary embodiment of a winged attachment nut, according to the present disclosure.
Figure 3:
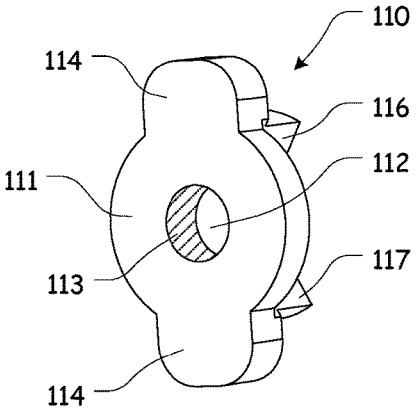
FIG. 3 illustrates a second, front view of an exemplary embodiment of a winged attachment nut, according to the present disclosure.
Figure 4:
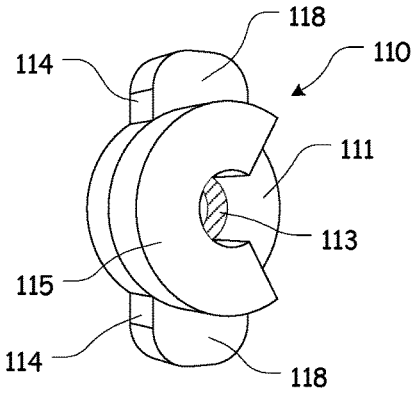
FIG. 4 illustrates a first, rear view of an exemplary embodiment of a winged attachment nut, according to the present disclosure.
Figure 5:
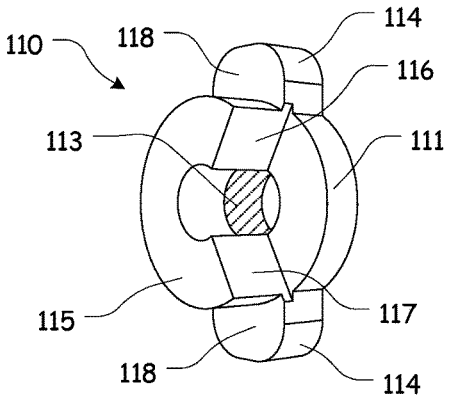
FIG. 5 illustrates a second, rear view of an exemplary embodiment of a winged attachment nut, according to the present disclosure.
Figure 6:
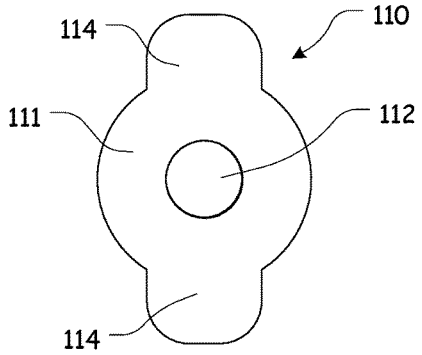
FIG. 6 illustrates a front view of an exemplary embodiment of a winged attachment nut, according to the present disclosure.

For simplicity and clarification, the design factors and operating principles of the rail accessory attachment system according to the present disclosure are explained with reference to various exemplary embodiments of a rail accessory attachment system according to the present disclosure. The basic explanation of the design factors and operating principles of the rail accessory attachment system is applicable for the understanding, design, and operation of the present disclosure. It should be appreciated that the present disclosure can be adapted to many applications where removable attachment of accessories or other devices is desired.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "handguard", "accessory portion", "winged attachment nut", and "mounting aperture" are used for basic explanation and understanding of the operation of the systems, methods, and apparatuses of this disclosure. Therefore, the terms "handguard", "accessory portion", "winged attachment nut", and "mounting aperture" are not to be construed as limiting the systems, methods, and apparatuses of this disclosure. Thus, for example, the term "accessory portion" is to be understood to broadly include any accessory or device capable of being attached or coupled to an object.

For simplicity and clarification, the rail accessory attachment system of this disclosure will be described as being used in conjunction with a handguard for a firearm, such as a rifle or carbine. However, it should be appreciated that these are merely exemplary embodiments of the rail accessory attachment system and are not to be construed as limiting this disclosure.

Turning now to the drawing portion FIGS., FIG. 1 illustrates certain components of an AR-15 style upper receiver 20, having an attached, free float handguard 40.

Generally, a barrel is aligned with and inserted into the upper receiver 20. A gas tube extends between the upper receiver 20 and a gas block. A muzzle device, such as a flash hider, flash suppressor, compensator, or muzzle brake is typically secured to the barrel.

While not illustrated in FIG. 1, the barrel is typically secured to the upper receiver 20 via interaction of a threaded portion of the upper receiver 20 and an internally threaded barrel nut.

The free float handguard 40 is typically attached to the standard barrel nut, a modified barrel nut, or the threaded portion of the upper receiver 20. As illustrated, the handguard 40 includes accessory rail portions 45 that extend along substantially the entire length of the handguard 40 at the 12 o'clock, 3 o'clock, 6 o'clock, and 9 o'clock positions.

It should also be appreciated that a more detailed explanation of the components of the upper receiver 20, lower receiver, barrel, barrel nut, gas tube, gas block, muzzle device, and free float handguard 40, instructions regarding how to attach and/or remove the various components and other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the present disclosure as described.

FIGS. 2-31 illustrate certain elements and/or aspects of an exemplary embodiment of a rail accessory attachment system 100, according to the present disclosure. As illustrated in FIGS. 2-31, the rail accessory attachment system 100 comprises at least one winged attachment nut 110, an accessory portion 120, an optional accessory plate 130, and at least one corresponding attachment bolt 150. The rail accessory attachment system 100 is able to be releasably attached or coupled to a representative handguard portion 140 having one or more double-keyhole mounting apertures 142.

Figure 16:
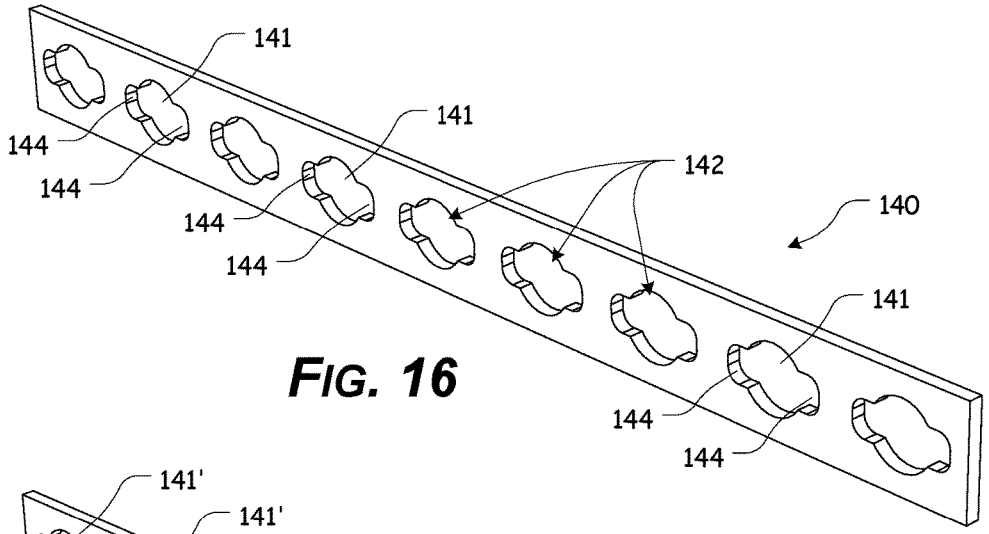
FIG. 16 illustrates a perspective view of an exemplary embodiment of a representative handguard portion incorporating an exemplary embodiment of a plurality of double-keyhole mounting apertures for the rail accessory attachment system, according to the present disclosure.

As illustrated most clearly in FIG. 16, each double-keyhole mounting aperture 142 of the representative handguard portion 140 includes a larger diameter through-hole 141 combined with two, comparatively more narrow keyhole slots 144 that extend from opposing sides of the through-hole 141. While the double-keyhole mounting aperture 142 is shown as having a substantially circular through-hole 141 and rounded keyhole slots 144, it should be appreciated that the double-keyhole mounting aperture 142 may comprise a through-hole 141 having a square, rectangular, triangular, or any other overall shape. Likewise, the keyhole slots 144 may comprise slots having a square, rectangular, triangular, or other overall shape.

Figure 17:
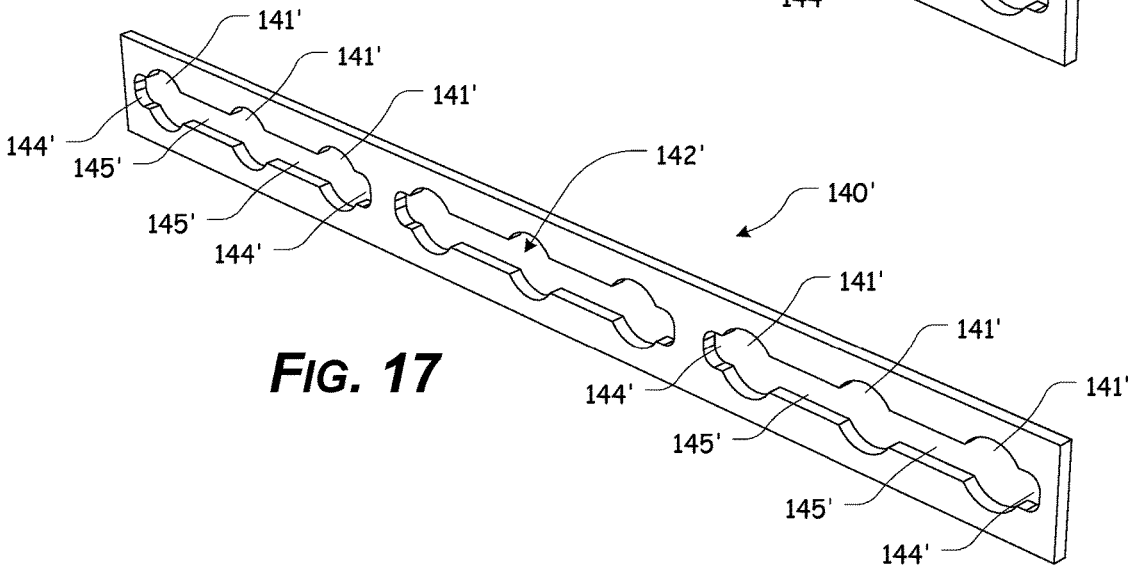
FIG. 17 illustrates a perspective view of an exemplary embodiment of a representative handguard portion incorporating an exemplary embodiment of a plurality of double-keyhole mounting apertures for the rail accessory attachment system, according to the present disclosure.
Figure 18:
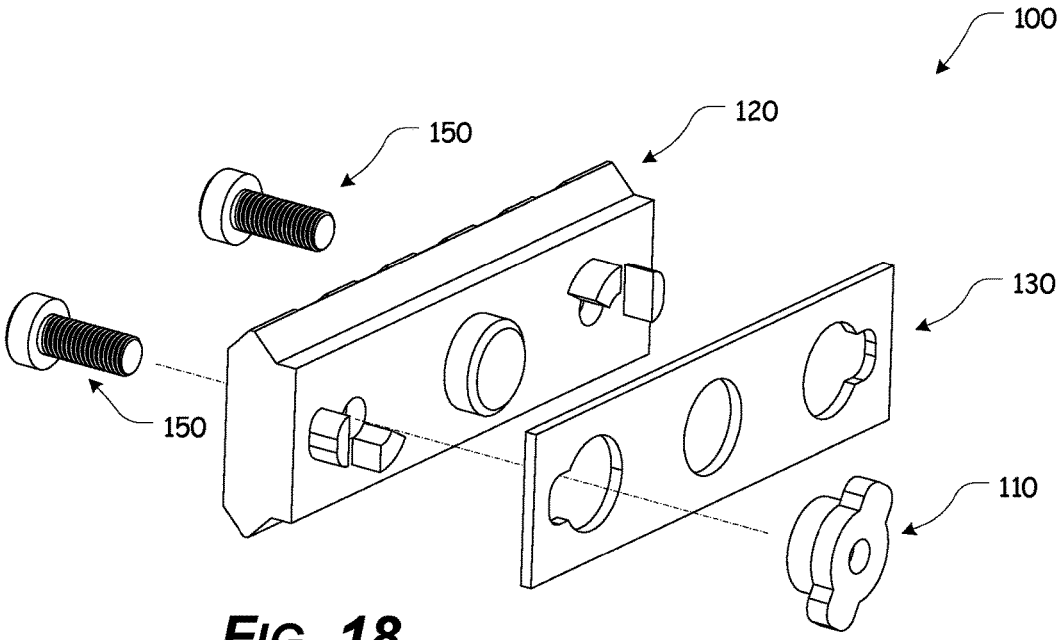
FIG. 18 illustrates an exploded, perspective view of certain components of an exemplary embodiment of a rail accessory attachment system, according to the present disclosure.
Figure 19:
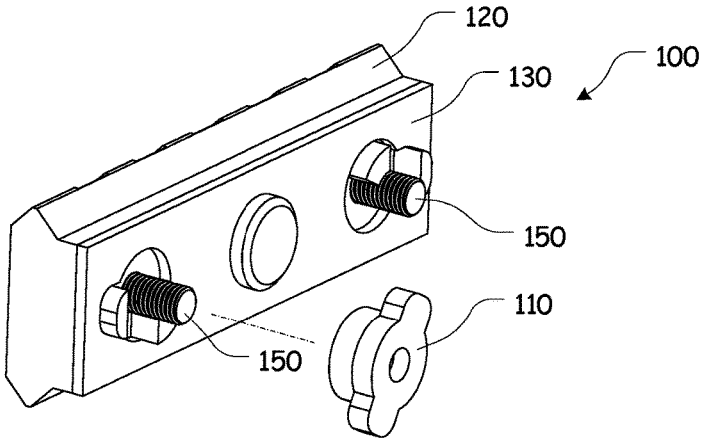
FIG. 19 illustrates an exploded, perspective view of certain components of an exemplary embodiment of a rail accessory attachment system, wherein the accessory plate is abutted against the accessory portion, according to the present disclosure.
Figure 20:
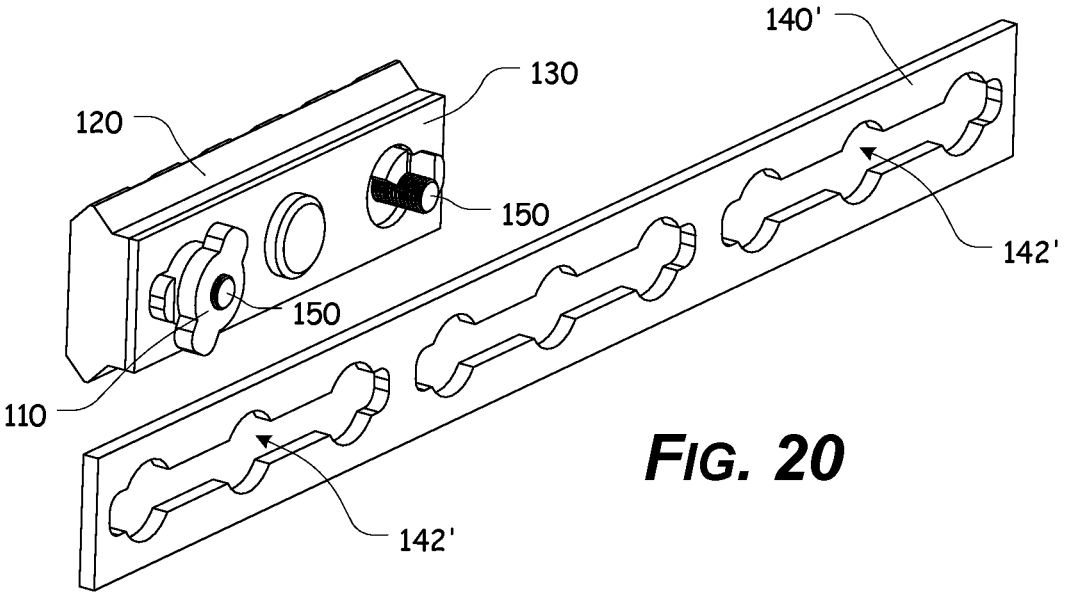
FIG. 20 illustrates an exploded, perspective view of certain components of an exemplary embodiment of a rail accessory attachment system, wherein a winged attachment nut is attached or coupled to the accessory portion, according to the present disclosure.
Figure 21:
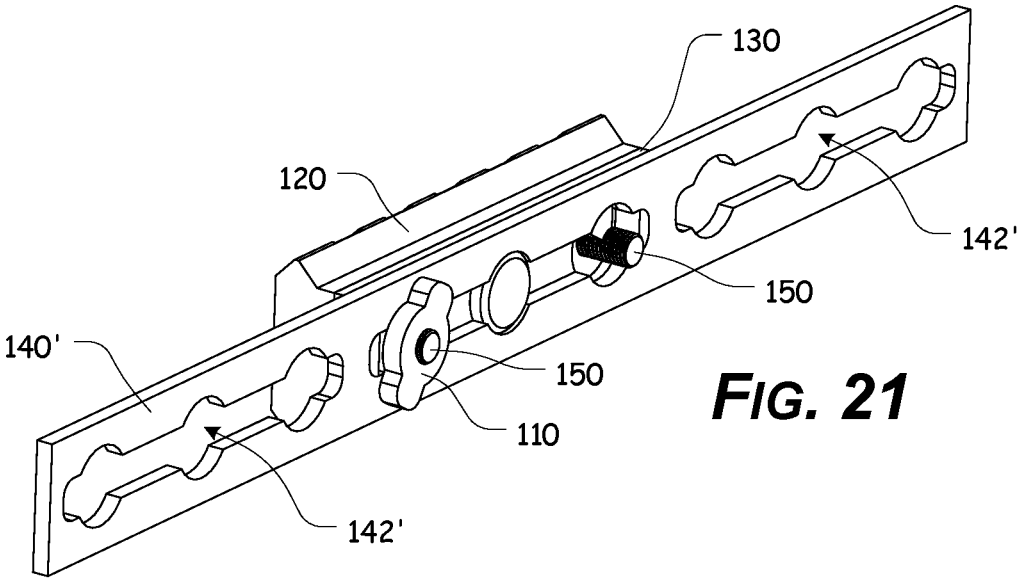
FIG. 21 illustrates an exploded, perspective view of certain components of an exemplary embodiment of a rail accessory attachment system, wherein the accessory portion is attached or coupled to a representative handguard portion, according to the present disclosure.
Figure 22:
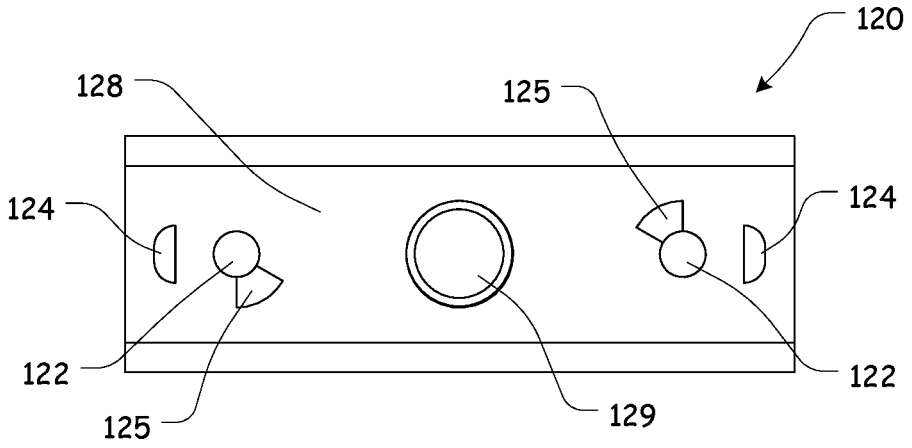
FIG. 22 illustrates an rear view of an exemplary embodiment of a rail accessory portion, according to the present disclosure.
Figure 23:
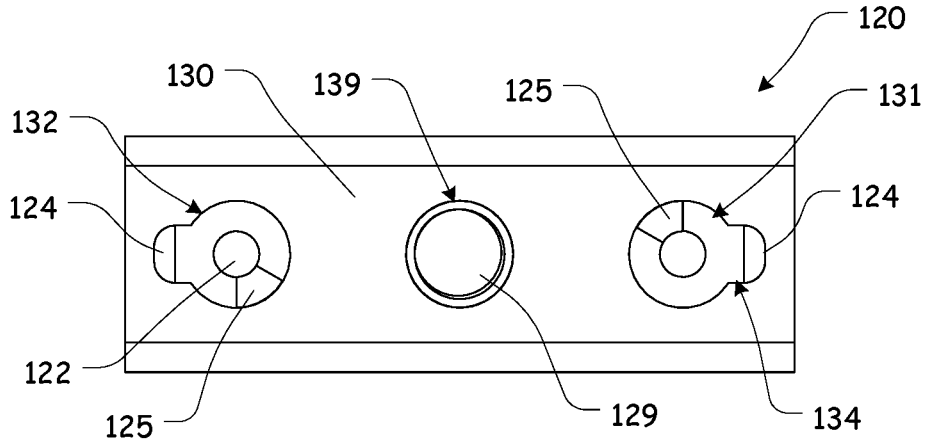
FIG. 23 illustrates an rear view of an exemplary embodiment of the accessory plate abutted against the accessory portion, according to the present disclosure.

As illustrated in FIG. 17, a representative handguard portion 140' may optionally comprise an extended double-keyhole mounting aperture 142'. As illustrated, each extended double-keyhole mounting aperture 142' includes a plurality of larger diameter through-holes 141' joined by linking slots 145'. A narrow keyhole slot 144' extends from opposing sides of spaced apart through-holes 141'.

Each winged attachment nut 110 includes a central portion 111 having an exterior shape that substantially corresponds to the shape defined by the through-hole 141 or is at least able to be at least partially fitted through the through-hole 141. Thus, if the through-hole 141 is substantially circular, the central portion 111 may be substantially circular, but will at least be sized so as to be at least partially fitted through the through-hole 141.

Wing portions 114 extend from opposing sides of the central portion 111. The wing portions 114 are comparatively more narrow than the central portion 111 and an outer diameter of the central portion 111 of each winged attachment nut 110 is sized and shaped so as to be urged through a corresponding through-hole 141 of the double-keyhole mounting aperture 142. Similarly, the wing portions 114 of each winged attachment nut 110 are sized and shaped so as to be urged through the keyhole slots 144. Thus, the exterior shape of the winged attachment nut 110 substantially corresponds to the shape of the double-keyhole mounting aperture 142.

In certain exemplary embodiments, the exterior shape of the winged attachment nut 110 may not correspond to the shape of the double-keyhole mounting aperture 142, but is of a size and shape so as to be urged through at least a portion of the keyhole slot 144.

A nut aperture 112 is formed through the winged attachment nut 110, substantially at a center of the central portion 111, along the longitudinal axis of the winged attachment nut 110. The nut aperture 112 is at least partially or fully threaded so as to allow the threaded aperture to interact with a threaded portion of an attachment bolt 150.

An at least partially, cylindrically shaped portion extends from a mating surface 118 of the winged attachment nut 110 to form a nut stop 115. As illustrated, the nut stop 115 is formed so as to interact with an accessory stop 125 extending from the mating surface 128 of the accessory portion 120.

Figure 7:
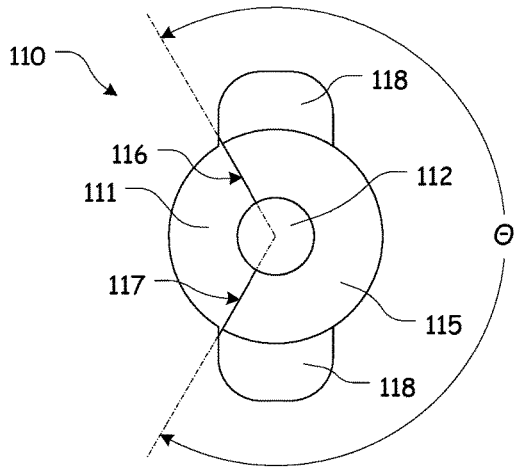
FIG. 7 illustrates a rear view of an exemplary embodiment of a winged attachment nut, according to the present disclosure.
Figure 8:
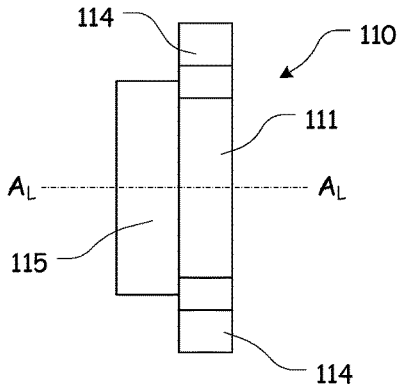
FIG. 8 illustrates a first, side view of an exemplary embodiment of a winged attachment nut, according to the present disclosure.
Figure 9:
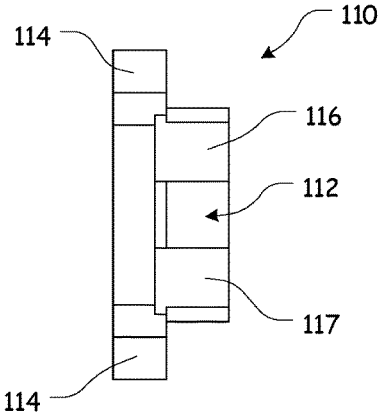
FIG. 9 illustrates a second, side view of an exemplary embodiment of a winged attachment nut, according to the present disclosure.
Figure 10:
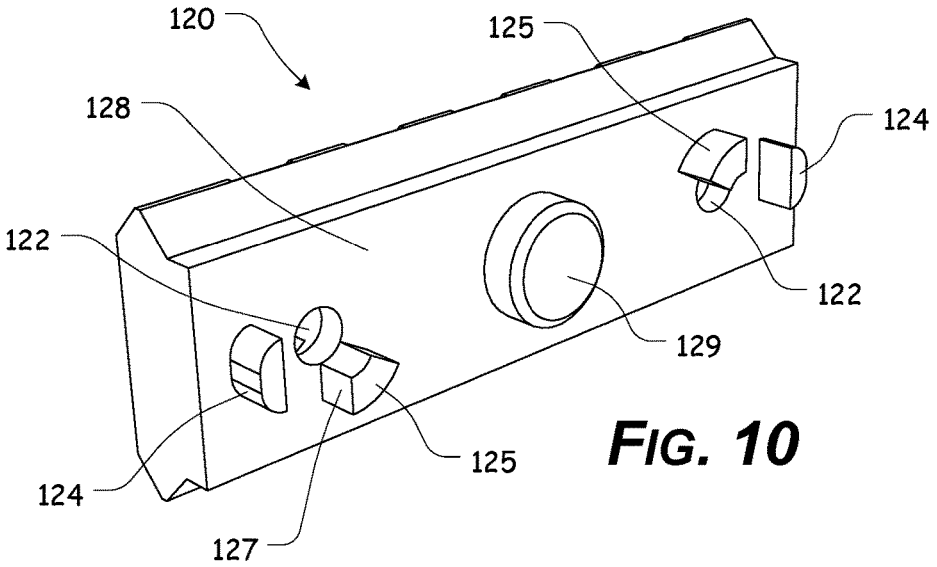
FIG. 10 illustrates a first, rear perspective view of an exemplary embodiment of an accessory portion, according to the present disclosure.
Figure 11:
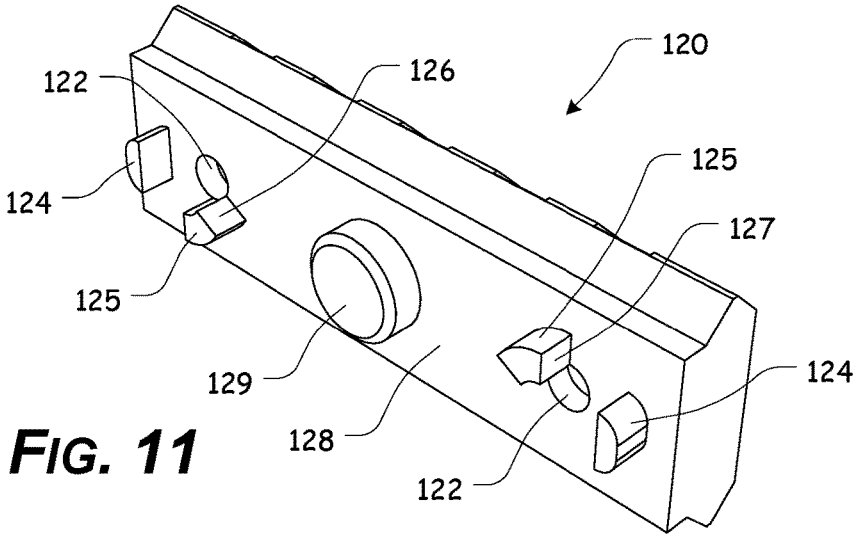
FIG. 11 illustrates a second, rear perspective view of an exemplary embodiment of an accessory portion, according to the present disclosure.
Figure 12:
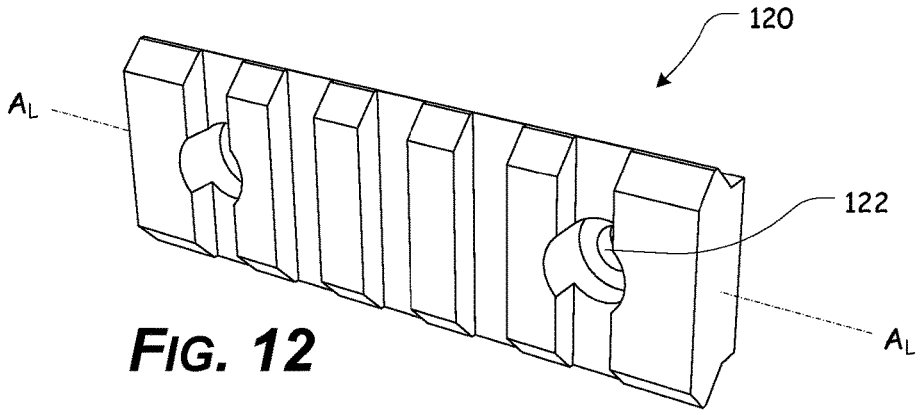
FIG. 12 illustrates a front, perspective view of an exemplary embodiment of an accessory portion, according to the present disclosure.
Figure 13:
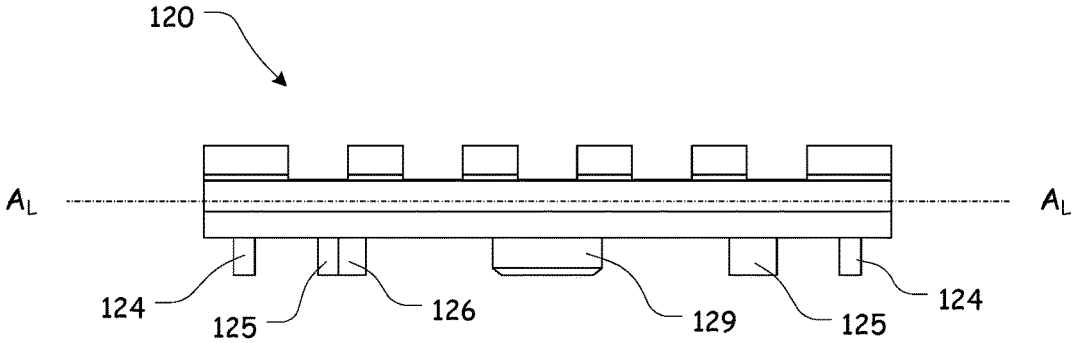
FIG. 13 illustrates a side view of an exemplary embodiment of an accessory portion, according to the present disclosure.
Figure 14:
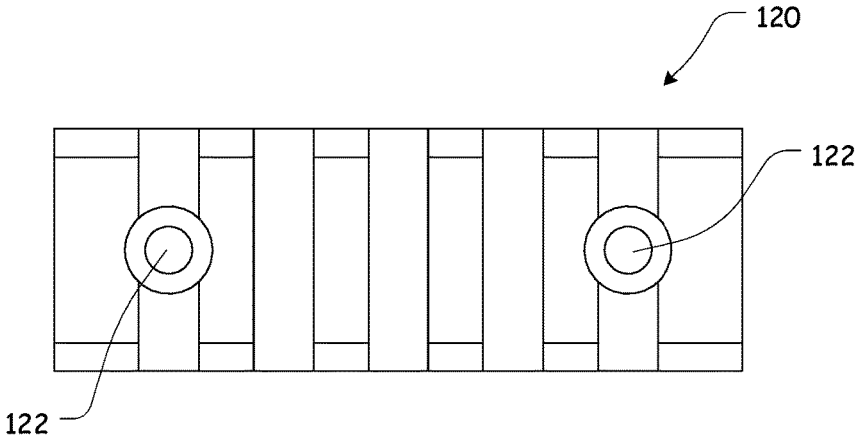
FIG. 14 illustrates a front view of an exemplary embodiment of an accessory portion, according to the present disclosure.
Figure 15:
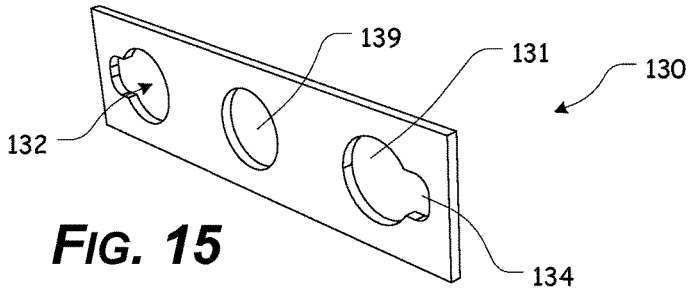
FIG. 15 illustrates a perspective view of an exemplary embodiment of an accessory plate, according to the present disclosure.

The nut stop 115 extends from a first nut stop surface 116 to a second nut stop surface 117 and comprises between approximately half and greater than half of a hollow cylinder, as represented by e in FIG. 7. However, it should be appreciated that the nut stop 115 may comprise a e of greater or less than a 180° portion of a hollow cylinder. In these exemplary embodiments, the wing portions 114 have more surface area to support attachment of the accessory portion 120.

As illustrated, the accessory portion 120 comprises a portion of Picatinny rail that extends from a substantially planar mating surface 128. It should be appreciated that the length of the accessory portion 120 may vary based upon the intended use of the accessory portion 120. Likewise, it should also be appreciated that the accessory portion 120 can comprise any portion of accessory or attachment device, such as, for example, a bipod mount, flashlight mount, handle mount, optic mount, or other element or device that is to be attached to a representative handguard portion 140.

The accessory portion 120 includes one or more accessory apertures 122 formed therethrough, depending upon the length and desired degree of attachment of the accessory portion 120. Each accessory aperture 122 is spaced so as to be aligned with a through-hole 141 of the double-keyhole mounting apertures 142 formed in the representative handguard portion 140.

An accessory stop 125 extends from a mating side of the accessory portion 120 around at least a portion of each accessory aperture 122. Each accessory stop 125 comprises an at least partially cylindrical shaped portion that extends from a first accessory stop surface 216 to a second accessory stop surface 217 from the mating surface 128 of the accessory portion 120 to form an accessory stop 125. As illustrated, the accessory stop 125 is formed so as to interact with a nut stop 115 extending from the mating surface 118 of the winged attachment nut 110.

As illustrated, the accessory stop 125 comprises between approximately less than a one third and one quarter of a hollow cylinder, between the first accessory stop surface 126 and the second accessory stop surface 127. However, it should be appreciated that the accessory stop 125 may comprise a greater or less than 30° to 45° portion of a hollow cylinder, between the first accessory stop surface 126 and the second accessory stop surface 127. In these exemplary embodiments, the wing portions 114 have more surface area to support attachment of the accessory portion 120.

Figure 24:
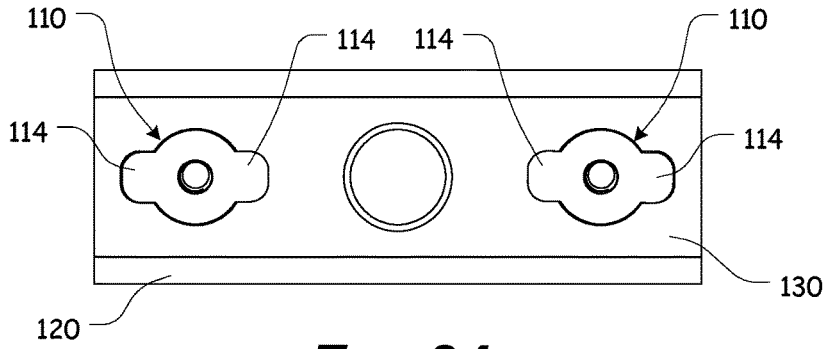
FIG. 24 illustrates a rear view of an exemplary embodiment of a rail accessory attachment system, wherein winged attachment nuts are attached or coupled to the accessory portion and are in an unlocked or attaching position, according to the present disclosure.
Figure 25:
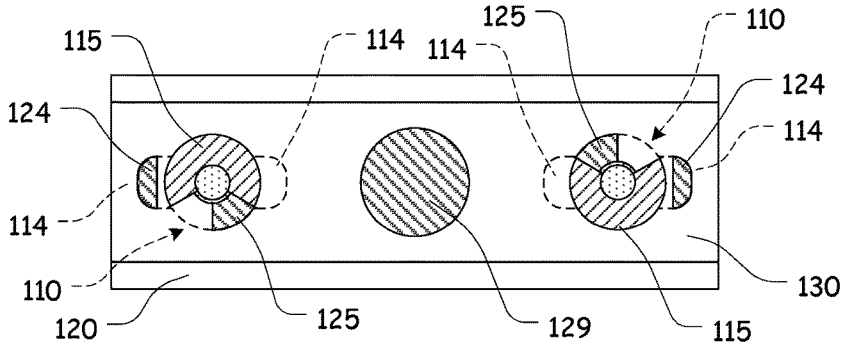
FIG. 25 illustrates a rear, partial cutaway view of an exemplary embodiment of a rail accessory attachment system, wherein winged attachment nuts are attached or coupled to the accessory portion and are in an unlocked or attaching position, according to the present disclosure.
Figure 26:
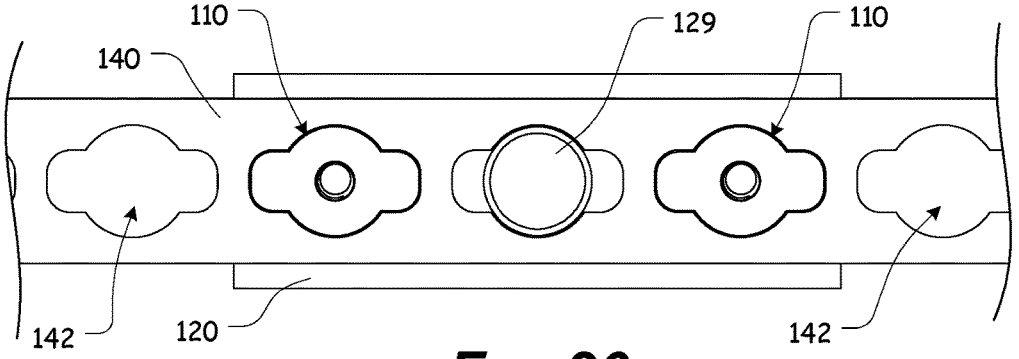
FIG. 26 illustrates a rear, partial cutaway view of an exemplary embodiment of a rail accessory attachment system, wherein the accessory portion and the optional accessory plate are abutted against a representative handguard portion and the winged attachment nuts are in an unlocked or attaching position, according to the present disclosure.
Figure 27:
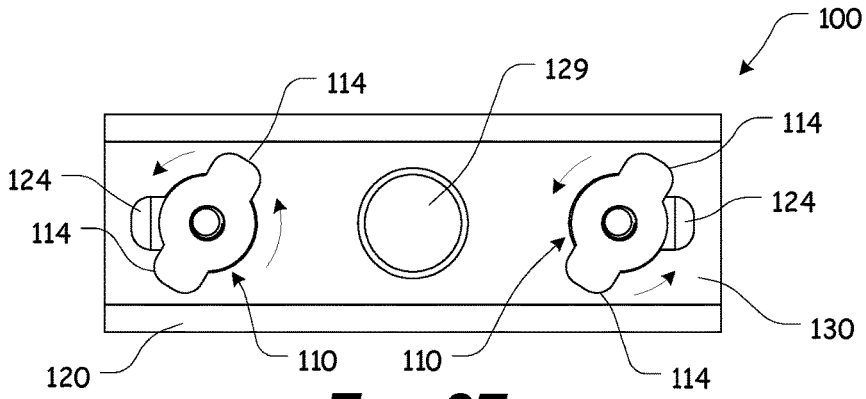
FIG. 27 illustrates a rear view of an exemplary embodiment of a rail accessory attachment system, wherein winged attachment nuts are attached or coupled to the accessory portion and are in a locked or attached position, according to the present disclosure.
Figure 28:
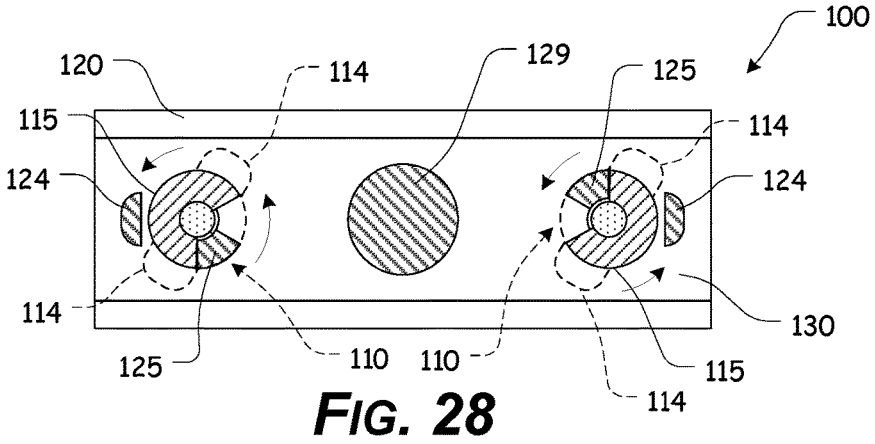
FIG. 28 illustrates a rear, partial cutaway view of an exemplary embodiment of a rail accessory attachment system, wherein winged attachment nuts are attached or coupled to the accessory portion and are in a locked or attached position, according to the present disclosure.
Figure 29:
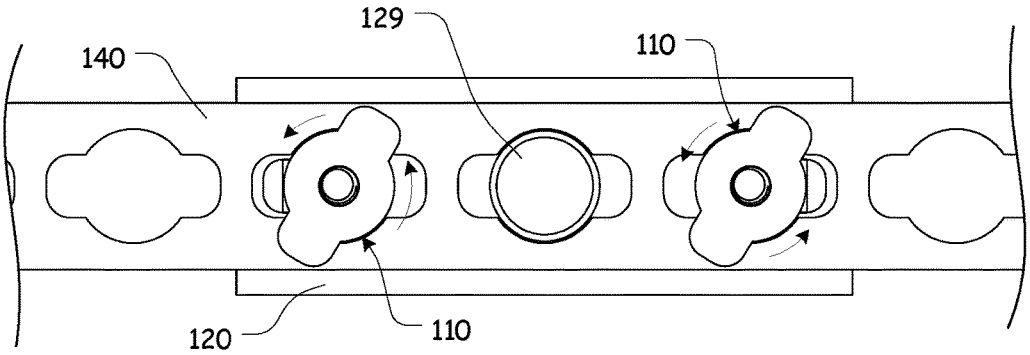
FIG. 29 illustrates a rear, partial cutaway view of an exemplary embodiment of a rail accessory attachment system, wherein the accessory portion and the optional accessory plate are abutted against a representative handguard portion and the winged attachment nuts are in a locked or attached position, according to the present disclosure.

By limiting the rotation of the winged attachment nut 110 relative to the accessory portion 120, the winged attachment nut 110 can rotate from an unlocked position, as illustrated in FIGS. 24-26, wherein the wing portions 114 extend substantially parallel to the longitudinal axis of the accessory portion 120, to a locked position, as illustrated in FIGS. 27-29, wherein the wing portions 114 extend other than parallel to the longitudinal axis of the accessory portion 120.

In various exemplary embodiments, one or more accessory alignment protrusions 129 to extend from the mating surface 128 of the accessory portion 120. If included, each alignment protrusion 129 is formed so as to interact with one or more of the double-keyhole mounting apertures 142 or other alignment apertures formed in the representative handguard portion 140 or other similar handguard or other portion. If included, each alignment protrusion 129 further aligns the accessory portion 120 with one or more of the double-keyhole mounting apertures 142. Each accessory alignment protrusion 129, once aligned with a double-keyhole mounting aperture 142 or other alignment aperture, helps to reduce or eliminate lateral or other movement of the accessory portion 120 relative to the representative handguard portion 140.

In various exemplary embodiments, one or more accessory alignment projections 124 to extend from the mating surface 128 of the accessory portion 120. If included, each alignment projection 124 is formed so as to interact with one or more of the double-keyhole mounting apertures 142 or other alignment apertures formed in the representative handguard portion 140 or other similar handguard or other portion. If included, each alignment projection 124 further aligns the accessory portion 120 with one or more of the double-keyhole mounting apertures 142. Each accessory alignment projection 124, once aligned with a double-keyhole mounting aperture 142 or other alignment aperture, helps to reduce or eliminate lateral or other movement of the accessory portion 120 relative to the representative handguard portion 140.

In various exemplary embodiments, an optional accessory plate 130 may optionally be positioned between the mating surface 128 of the accessory portion 120 and the surface of the representative handguard portion 140. If included, the optional accessory plate is utilized to remove any gap or additional space between the mating surface 128 of the accessory portion 120 and the surface of the representative handguard portion 140.

Each optional accessory plate 130 comprises at least one accessory plate aperture 139 formed so as to receive and/or accept at least a portion of the accessory alignment protrusion 129 therein. The optional accessory plate 130 further comprises at least one accessory plate single-keyhole aperture 132 having a substantially circular through-hole 131 and rounded keyhole slot 134 extending from the circular through-hole 131. The single-keyhole aperture 132 is formed so as to receive and/or accept at least a portion of one or more accessory alignment projections 124 therein. In this manner, the accessory plate 130 can be aligned with one or more of the accessory plate keyhole apertures 124 accessory alignment protrusions 129, as illustrated most clearly in FIGS. 18-20.

It should be appreciated that a plurality of double-keyhole mounting apertures 142 are typically formed at spaced apart locations from one another so as to allow attachment via more than one winged attachment nut 110 per accessory portion 120. Thus, it should be appreciated that the accessory portion 120 may comprise accessory apertures 122 positioned at spaced apart locations equal and corresponding to the spaced apart locations of the double-keyhole mounting apertures 142.

In various exemplary embodiments, various components of the rail accessory attachment system 100 are substantially rigid and are formed of steel. Alternate materials of construction of the various components of the rail accessory attachment system 100 may include one or more of the following portion: stainless steel, aluminum, titanium, and/or other metals, as well as various alloys and composites thereof, plastic, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the heat shielding tube is a design choice based on the desired appearance and functionality of the heat shielding tube.

It should be appreciated that certain elements of the rail accessory attachment system 100 may be formed as an integral unit, such as, for example, the accessory portion 120 and the optional accessory plate 130. Alternatively, suitable materials can be used and sections or elements of the rail accessory attachment system 100 may be made independently and attached or coupled together, such as by adhesives, welding, screws, bolts, rivets, pins, or other fasteners, to form the rail accessory attachment system 100.

During assembly and/or installation rail accessory attachment system 100, the nut aperture 112 of the winged attachment nut 110 is aligned with the accessory aperture 122 of the accessory portion 120, such that the threaded portion of the attachment bolt 150 is able to pass through the accessory aperture 122 and interact with the threaded portion 113 of the nut aperture 112 to secure the winged attachment nut 110 to the accessory portion 120.

If the optional accessory plate 130 is utilized, the accessory plate 130 is appropriately positioned and abutted against the mating surface 128 prior to the winged attachment nuts 110 being attached or coupled to the accessory portion 120.

The winged attachment nut 110 is secured to the accessory portion 120 such that the winged attachment nut 110 is able to rotate until the nut stop 115 interacts with the accessory stop 125 and rotation of the winged attachment nut 110 is stopped. More specifically, the winged attachment nut 110 is able to rotate until the first nut stop surface 116 contacts the first accessory stop surface 126 or the second nut stop surface 117 contacts the second accessory stop surface 127.

In various exemplary embodiments, the winged attachment nut 110 is able to rotate between approximately 30° and 90°.

Once the winged attachment nut 110 is secured, via the attachment bolt 150, to the accessory portion 120, an accessory assembly is formed. The accessory assembly can then be releasably attached or coupled to a representative handguard portion 140 (or other element or device having an appropriate mounting aperture 142 or 142').

As illustrated most clearly in FIGS. 24-31, the accessory assembly is releasably attached or coupled to a portion of a representative handguard portion 140 when the winged attachment nut 110 is rotated to the unlocked position, via rotation of the attachment bolt 150, and urged through a desired double-keyhole mounting aperture 142, such that the mating surface 128 of the accessory portion 120 (of an optional accessory plate 130) contacts an outer surface of the representative handguard portion 140.

Once appropriately positioned, the winged attachment nut 110 is rotated to the locked position, via rotation of the attachment bolt 150. Once rotated to the locked position, the mating surfaces 118 of the winged attachment nut 110 extend beyond the mounting aperture 142 or 142', and the accessory assembly is secured to the representative handguard portion 140.

In various exemplary embodiments, the mating surfaces 118 of the winged attachment nut 110 include ramped surfaces, such that continued rotation of the winged attachment nut 110 from the unlocked to the locked position provides increased securing force between the mating surfaces 118 of the winged attachment nut 110 and the surface of the representative handguard portion 140.

Once the winged attachment nut 110 is rotated to the locked position (through, for example, an initial one third to half turn of the attachment bolt 150), further rotation of the attachment bolt 150 adjusts the gap between the mating surface 118 of the winged attachment nut 110 and the inner surface of the representative handguard portion 140, drawing the winged attachment nut 110 and the rail accessory portion 120 together, further clamping them to the representative handguard portion 140. Additionally, because the gap between the mating surface 118 of the winged attachment nut 110 and the mating surface 128 of the accessory portion 120 can be adjusted, the accessory assembly can be used in connection with representative handguard portions 140 or other mating surfaces having varied thicknesses.

Figure 30:
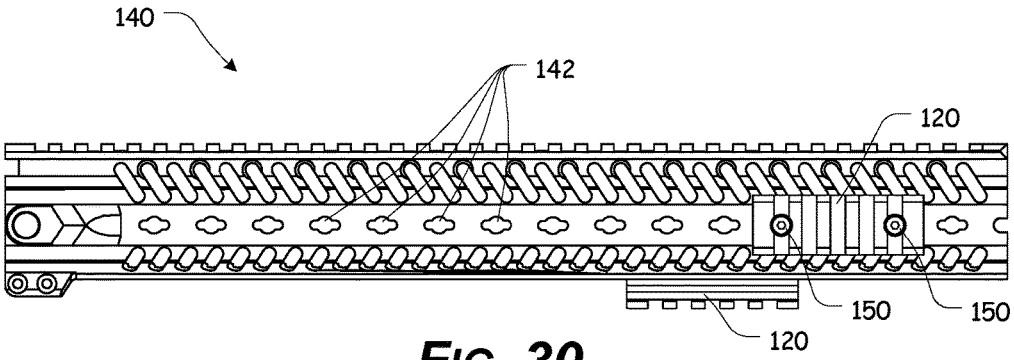
FIG. 30 illustrates a side view of an exemplary embodiment of a representative handguard portion incorporating a plurality of double-keyhole mounting apertures for the rail accessory attachment system, according to the present disclosure.
Figure 31:
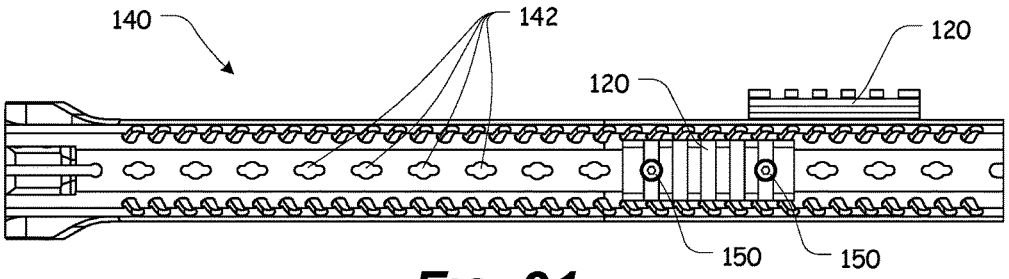
FIG. 31 illustrates a bottom view of an exemplary embodiment of a representative handguard portion incorporating a plurality of double-keyhole mounting apertures for the rail accessory attachment system, according to the present disclosure.
Figure 32:
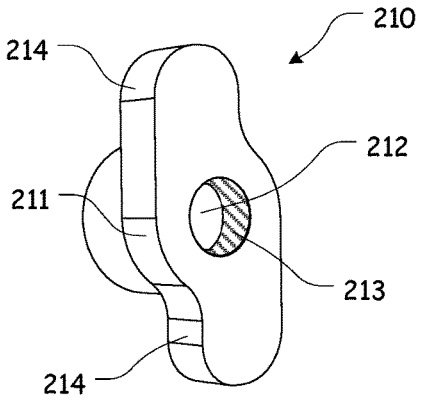
FIG. 32 illustrates a first, front perspective view of an exemplary embodiment of a winged attachment nut, according to the present disclosure.
Figure 33:
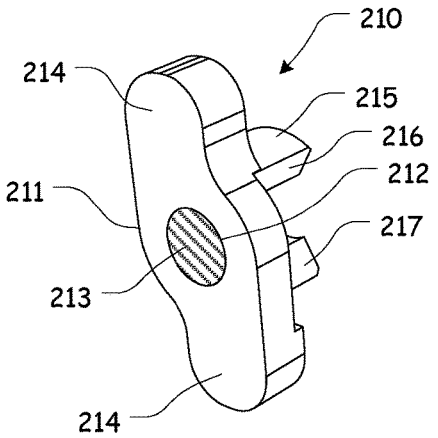
FIG. 33 illustrates a second, front view of an exemplary embodiment of a winged attachment nut, according to the present disclosure.
Figure 34:
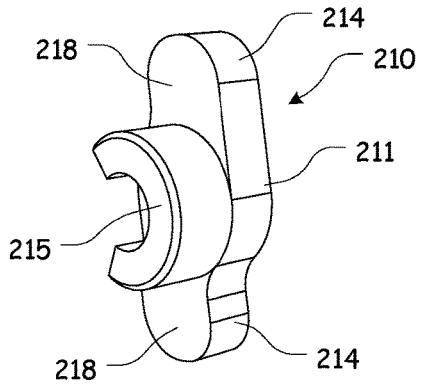
FIG. 34 illustrates a first, rear view of an exemplary embodiment of a winged attachment nut, according to the present disclosure.
Figure 35:
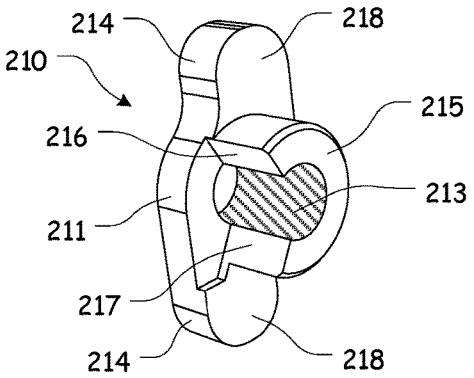
FIG. 35 illustrates a second, rear view of an exemplary embodiment of a winged attachment nut, according to the present disclosure.
Figure 36:
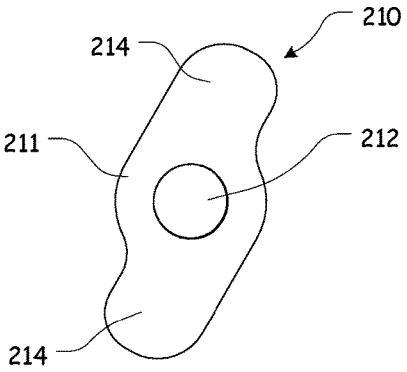
FIG. 36 illustrates a front view of an exemplary embodiment of a winged attachment nut, according to the present disclosure.
Figure 37:
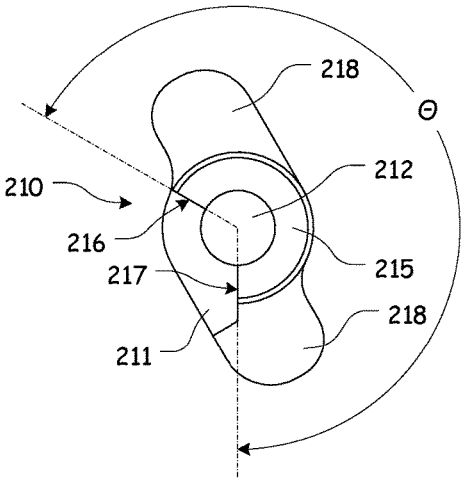
FIG. 37 illustrates a rear view of an exemplary embodiment of a winged attachment nut, according to the present disclosure.
Figure 38:
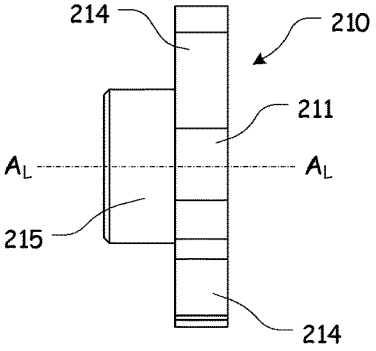
FIG. 38 illustrates a first, side view of an exemplary embodiment of a winged attachment nut, according to the present disclosure.
Figure 39:
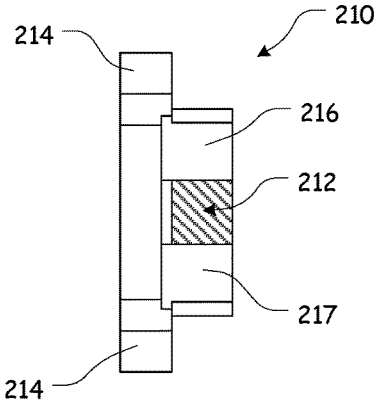
FIG. 39 illustrates a second, side view of an exemplary embodiment of a winged attachment nut, according to the present disclosure.
Figure 40:
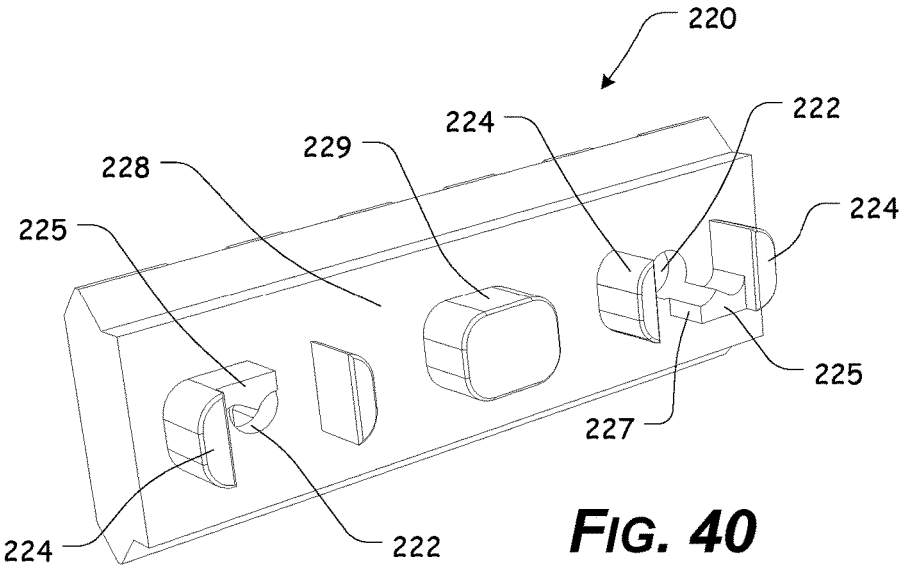
FIG. 40 illustrates a first, rear perspective view of an exemplary embodiment of an accessory portion, according to the present disclosure.
Figure 41:
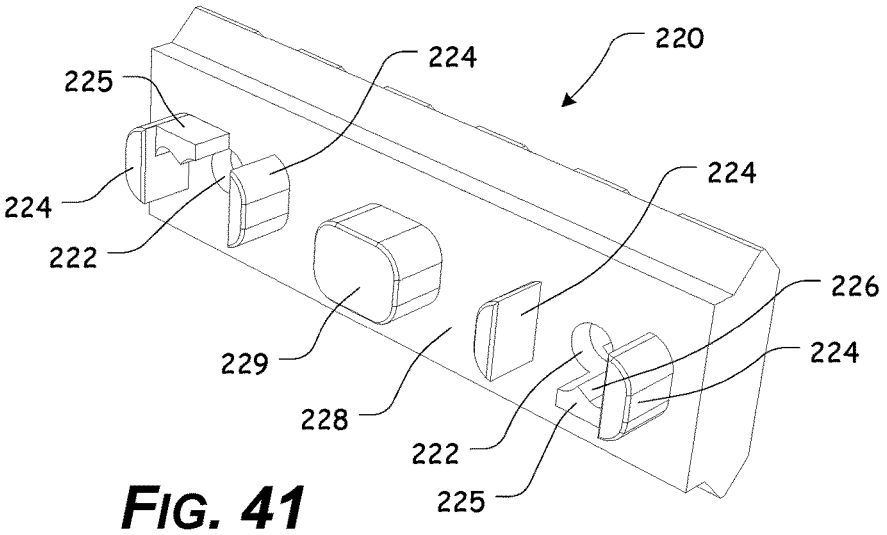
FIG. 41 illustrates a second, rear perspective view of an exemplary embodiment of an accessory portion, according to the present disclosure.
Figure 42:
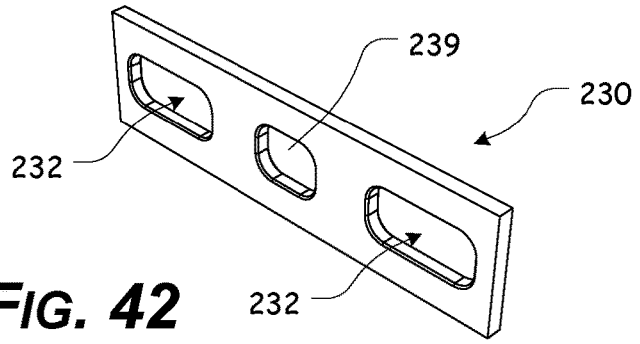
FIG. 42 illustrates a perspective view of an exemplary embodiment of an accessory plate, according to the present disclosure.
Figure 43:
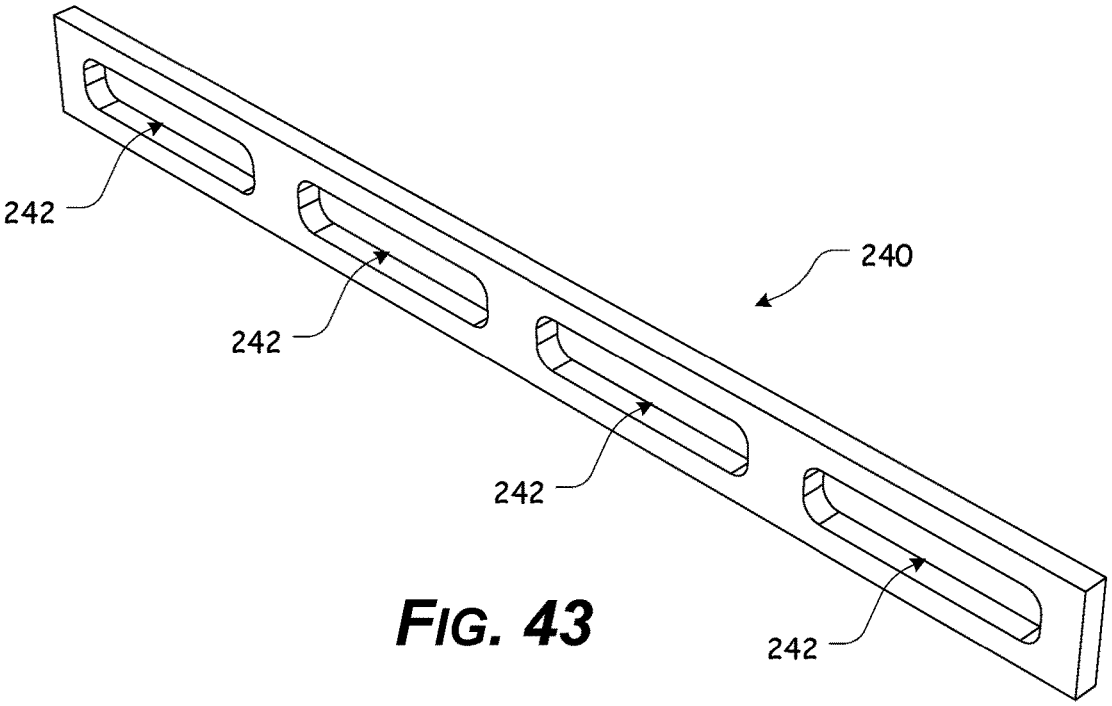
FIG. 43 illustrates a perspective view of an exemplary embodiment of a representative handguard portion incorporating an exemplary embodiment of a plurality of double-keyhole mounting apertures for the rail accessory attachment system, according to the present disclosure.
Figure 44:
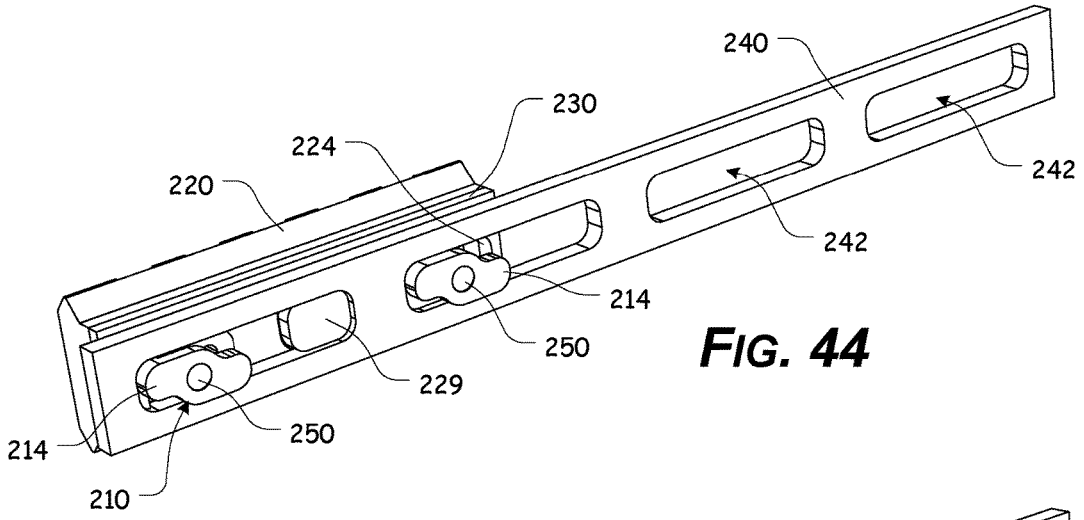
FIG. 44 illustrates a rear, partial cutaway view of an exemplary embodiment of a rail accessory attachment system, wherein the accessory portion and the optional accessory plate are abutted against a representative handguard portion and the winged attachment nuts are in an unlocked or attaching position, according to the present disclosure.
Figure 45:
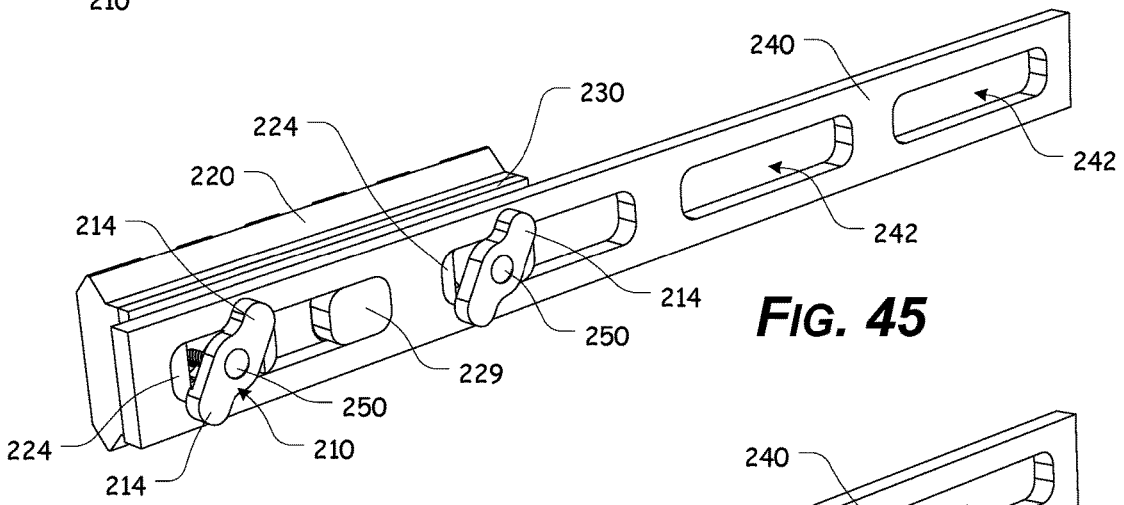
FIG. 45 illustrates a rear, partial cutaway view of an exemplary embodiment of a rail accessory attachment system, wherein the accessory portion and the optional accessory plate are abutted against a representative handguard portion and the winged attachment nuts are in a locked or attached position, according to the present disclosure.
Figure 46:
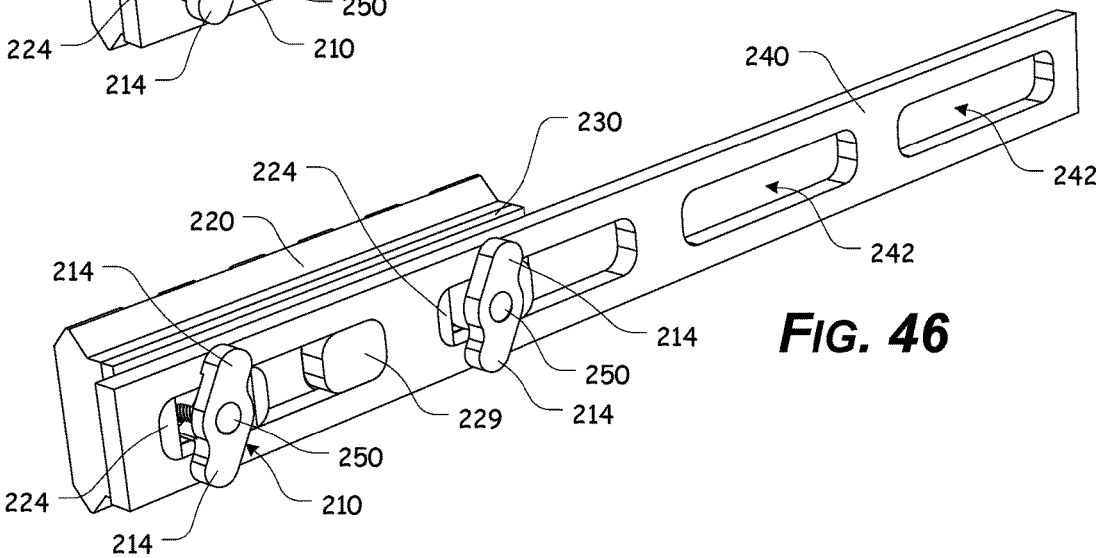
FIG. 46 illustrates a rear, partial cutaway view of an exemplary embodiment of a rail accessory attachment system, wherein the accessory portion and the optional accessory plate are abutted against a representative handguard portion and the winged attachment nuts are in a locked or attached position, according to the present disclosure.

FIGS. 30 and 31 illustrate a side and bottom view, respectively, of an exemplary embodiment of a representative handguard portion 140 incorporating a plurality of double-keyhole mounting apertures 142 for the rail accessory attachment system 100 and having 2 exemplary accessory portions 120 attached to the representative handguard portion 140, according to the present disclosure. As illustrated, the double-keyhole mounting apertures 142 are positioned at spaced apart locations along either a side or bottom of the exemplary representative handguard portion 140. Typically, the double-keyhole mounting apertures 142 are positioned along a line, so as to facilitate attachment of an accessory assembly at a desired position or location.

While the exemplary representative handguard portion 140 shows double-keyhole mounting apertures 142 positioned along the side and bottom of the representative handguard portion 140, it should be appreciated that the double-keyhole mounting apertures 142 may be positioned along any portion of the representative handguard portion 140. Also, it should be appreciated that a single double-keyhole mounting aperture 142 may be positioned at a desired location along the representative handguard portion 140 or 2 or more double-keyhole mounting apertures 142 may be located, as desired.

Thus, it should be understood that the number and/or placement of any double-keyhole mounting apertures 142 is a design choice based upon the desired functionality of the representative handguard portion 140 and rail accessory attachment system 100 of the present disclosure.

FIGS. 32-48 illustrate certain elements and/or aspects of an exemplary embodiment of a rail accessory attachment system 200, according to the present disclosure. As illustrated in FIGS. 32-48, the rail accessory attachment system 200 comprises at least some of a winged attachment nut 210 comprising wing portions 214 with mating surfaces 218 extending from a central portion 211, a nut stop 215 extending from a first nut stop surface 216 to a second nut stop surface 217, and a nut aperture 212 having a threaded portion 213; an accessory portion 220 having one or more accessory apertures 222, each accessory aperture having a corresponding accessory stop 225 extending from a first accessory stop surface 226 to a second accessory stop surface 227, one or more accessory alignment projections 224 extending from a mating surface 228 and one or more accessory alignment protrusions 229 to extend from the mating surface 228 of the accessory portion 220; an optional accessory plate 230 comprising at least one accessory plate single-keyhole aperture 232 having a substantially circular through-hole 231 and a keyhole slot 234 and at least one accessory plate aperture 239; and at least one corresponding attachment bolt 250.

It should be understood that each of these elements corresponds to and operates similarly to the winged attachment nut 110, the wing portions 114, the mating surfaces 118, the central portion 111, the nut stop 115, the first nut stop surface 116, the second nut stop surface 117, the nut aperture 112, the threaded portion 113, the accessory portion 120, the one or more accessory apertures 122, the accessory stop 125, the first accessory stop surface 126, the second accessory stop surface 127, the one or more accessory alignment projections 124, the mating surface 128, the one or more accessory alignment protrusions 129, the mating surface 128, and the at least one corresponding attachment bolt 150, as described above with reference to the rail accessory attachment system 100 of FIGS. 2-31.

However, as shown in FIGS. 32-48, the optional accessory plate 230 comprises at least one accessory plate aperture 239 formed so as to receive and/or accept at least a portion of the accessory alignment protrusion 229 therein. The optional accessory plate 230 further comprises at least one accessory plate aperture 232 having a substantially rectangular through-hole. The accessory plate aperture 232 is formed so as to receive and/or accept at least a portion of one or more accessory alignment projections 224 therein. In this manner, the accessory plate 230 can be aligned with one or more of the accessory plate keyhole apertures 224 and accessory alignment protrusions 229.

Furthermore, as illustrated most clearly in FIGS. 43-46, the representative handguard portion 240 includes a plurality of spaced apart, substantially rectangular mounting aperture 242.

Figure 47:
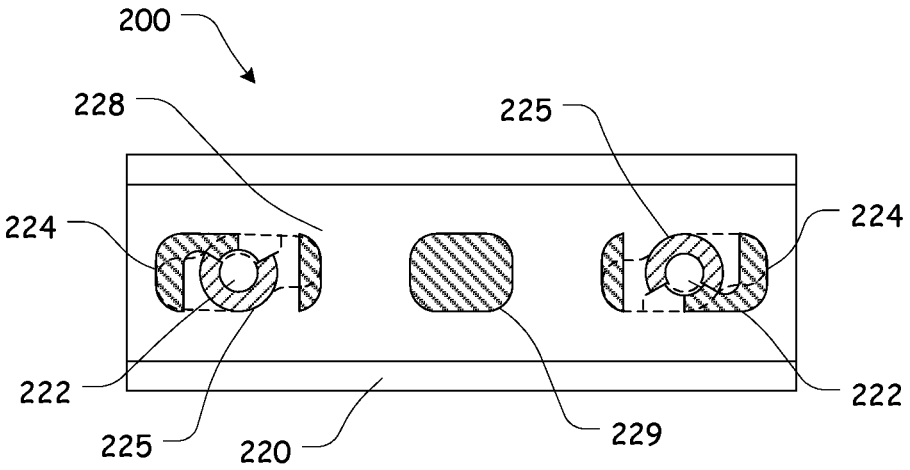
FIG. 47 illustrates a rear, partial cutaway view of an exemplary embodiment of a rail accessory attachment system, wherein winged attachment nuts are attached or coupled to the accessory portion and are in an unlocked or attaching position, according to the present disclosure.
Figure 48:
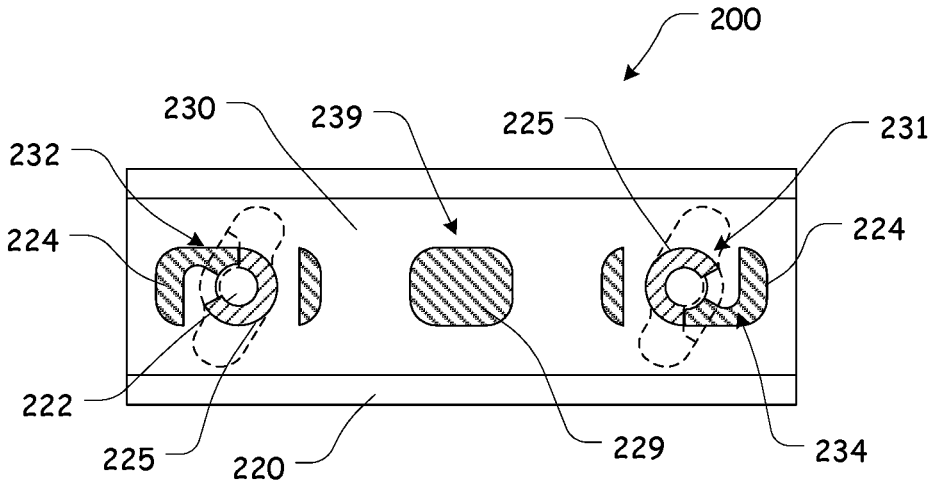
FIG. 48 illustrates a rear, partial cutaway view of an exemplary embodiment of a rail accessory attachment system, wherein winged attachment nuts are attached or coupled to the accessory portion and are in a locked or attached position, according to the present disclosure.

As illustrated most clearly in FIGS. 32-39 and 44-48, each winged attachment nut 210 includes wing portions 214 that extend four extends radially to form a substantially "S" or "Z" shaped winged attachment nut 210. Thus, the exterior shape of the winged attachment nut 210 and is sized and shaped so as to be urged through a substantially rectangular mounting aperture 242 when the winged attachment nut 210 is in an unlocked position, as illustrated in FIG. 47. Similarly, the wing portions 214 of each winged attachment nut 210 is sized and shaped so as to be kept from being urged through the substantially rectangular mounting aperture 242 when in a locked position, as illustrated in FIG. 48.

While this disclosure has been described in conjunction with the exemplary embodiments outlined above, the foregoing description of exemplary embodiments of the disclosure, as set forth above, are intended to be illustrative, not limiting and the fundamental disclosure should not be considered to be necessarily so constrained. It is evident that the disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the disclosure. The upper and lower limits of these smaller ranges may independently be included in the smaller ranges and is also encompassed within the disclosure, subject to any specifically excluded limit in the stated range. Where the stated range includes one or both of the limits, ranges excluding either or both of those included limits are also included in the disclosure.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, non-limiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawing portions. This statement is intended to serve as antecedent basis for use of such exclusive terminology as "solely", "only", and the like in connection with the recitation of claim elements or the use of a "negative" claim limitation(s).

What is claimed is:

1. A rail accessory attachment system, comprising:

one or more winged attachment nuts, wherein each winged attachment nut comprises two wing portions extending from a central portion of said winged attachment nut and a nut aperture formed through said winged attachment nut, wherein said nut aperture includes a threaded portion, wherein each winged attachment nut comprises a nut stop extending between a first nut stop surface and a second nut stop surface;

an accessory portion having one or more accessory apertures formed therethrough, wherein each accessory aperture comprises at least one associated accessory stop extending from a mating surface of said accessory portion and extending between a first accessory stop surface and a second accessory stop surface, wherein one or more accessory alignment projections extend from said mating surface of said accessory portion; and at least one attachment bolt, wherein said nut aperture is aligned with said accessory aperture, such that a threaded portion of said attachment bolt interacts with said threaded portion of said nut aperture to attach or couple said winged attachment nut to said accessory portion, such that said nut stop is aligned relative to said accessory stop so that said winged attachment nut is rotatable relative to said accessory portion between a position wherein said first nut stop surface interacts with said first accessory stop surface and a position wherein said second nut stop surface interacts with said second accessory stop surface.

2. The rail accessory attachment system of claim 1, wherein when said winged attachment nut is in a locked position, said first accessory stop surface contacts said first nut stop surface and wherein when said winged attachment nut is in an unlocked position, said second accessory stop surface contacts said second nut stop surface.

3. The rail accessory attachment system of claim 1, further comprising an accessory plate, wherein said accessory plate comprises at least one accessory plate aperture having a substantially rectangular through-hole.

4. The rail accessory attachment system of claim 1, wherein each winged attachment nut extends radially from said central portion.

5. The rail accessory attachment system of claim 1, wherein each winged attachment nut forms a substantially "S" or "Z" shaped winged attachment nut.

6. The rail accessory attachment system of claim 2, wherein when each winged attachment nut is in said unlocked position, each winged attachment nut can be urged through a mounting aperture formed in a surface and wherein when each winged attachment nut is in said locked position, said wing portions keep each winged attachment nut from being urged through said mounting apertures formed in said surface.

7. A rail accessory attachment system, comprising:

one or more winged attachment nuts, wherein each winged attachment nut comprises two wing portions extending from a central portion of said winged attachment nut and a nut aperture formed through said winged attachment nut, wherein each winged attachment nut comprises a nut stop, wherein said nut stop extends between a first nut stop surface and a second nut stop surface;

an accessory portion having one or more accessory apertures, wherein each accessory aperture comprises at least one associated accessory stop extending from a mating surface of said accessory portion and extending between a first accessory stop surface and a second accessory stop surface; and wherein said nut aperture is aligned with said accessory aperture, such that a threaded portion of an attachment bolt interacts with a threaded portion of said nut aperture to rotatably attach or couple said winged attachment nut to said accessory portion, such that said nut stop is aligned relative to said accessory stop so that said winged attachment nut is rotatable relative to said accessory portion between a position wherein said first nut stop surface interacts with said first accessory stop surface and a position wherein said second nut stop surface interacts with said second accessory stop surface.

8. The rail accessory attachment system of claim 7, wherein if said winged attachment nut is in a locked position said first accessory stop surface contacts said first nut stop surface and if said winged attachment nut is in an unlocked position said second accessory stop surface contacts said second nut stop surface.

9. The rail accessory attachment system of claim 7, wherein each winged attachment nut forms a substantially "S" or "Z" shaped winged attachment nut.

10. The rail accessory attachment system of claim 8, wherein when each winged attachment nut is in said unlocked position, each winged attachment nut can be urged through a mounting aperture formed in a surface and wherein when each winged attachment nut is in said locked position, said wing portions keep each winged attachment nut from being urged through said mounting apertures formed in said surface.

* * * * *